US012691975B2

(12) United States Patent
Mikacich

(10) Patent No.: US 12,691,975 B2
(45) Date of Patent: Jul. 28, 2026

(54) LASHING DEVICE FOR BOAT COVER SUSPENSION SYSTEM

(71) Applicant: Coburn Mikacich, Orlando, FL (US)

(72) Inventor: Coburn Mikacich, Orlando, FL (US)

( * ) Notice: Subject to any disclaimer, the term of this patent is extended or adjusted under 35 U.S.C. 154(b) by 535 days.

(21) Appl. No.: 18/350,981

(22) Filed: Jul. 12, 2023

(65) Prior Publication Data

US 2025/0019042 A1 Jan. 16, 2025

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 3,059,659 | A | 10/1962 | Ipsen | |
| 5,027,739 | A | 7/1991 | Lackovic | |
| 7,735,235 | B2 | 6/2010 | Waddell et al. | |
| 7,987,807 | B2 * | 8/2011 | Mikacich | B63B 17/02 114/361 |
| 10,179,629 | B1 | 1/2019 | Henderson, III | |
| 10,220,917 | B2 | 3/2019 | Pisapia | |
| 10,759,499 | B1 | 9/2020 | Henderson, III | |
| 10,864,965 | B2 | 12/2020 | Alexander | |
| 2003/0234036 | A1 | 12/2003 | Brower | |

* cited by examiner

*Primary Examiner* — Lars A Olson

(57) ABSTRACT

A boat cover suspension (i.e., lashing) device includes a first cap with a tubular fitting, an annular flange, and a divider bisecting and coextensive with the tubular fitting. A second cap includes a bushing and an annular body. The bushing securely receives a portion of the tubular fitting, where it is retained by friction, mechanical fastening and/or bonding. A portion of a boat cover is disposed between the annular flange and annular body. A tether engages the divider and a support structure, keeping the boat cover from sagging. Additional tether portions extend from the tubular fitting beneath the cover to anchor points, thereby supporting the portions of the cover from the suspension device to the anchor points.

20 Claims, 17 Drawing Sheets

LASHING DEVICE FOR BOAT COVER SUSPENSION SYSTEM

FIELD OF THE INVENTION

This invention relates generally to boat cover suspension systems, and, more particularly, to a lifting or lashing device that facilitates supporting a boat cover from above and below the cover.

BACKGROUND OF THE INVENTION

Boat covers protect the deck, cockpit, helm, cabin and keel of a boat from water damage and flooding. Often, a boat cover will sag under the weight of pooled water, which can lead to several problems and potential damage. Water accumulation adds considerable weight to the boat cover, which can strain the cover's material and the supporting framework. Over time, this additional weight can cause the cover to sag or even tear, compromising its effectiveness in protecting the boat. Pooled water increases the likelihood of leakage through the cover seams or any weak points. When water penetrates the cover, it can seep into the boat, potentially damaging the interior, electronics, upholstery, and other sensitive components. Excess moisture trapped under the pooled water creates an ideal environment for the growth of mold, mildew, and other fungi. These can cause unpleasant odors, stains, and structural damage to the boat's surfaces. Similarly, when water accumulates on the boat cover, it restricts proper airflow and ventilation, which is important for preventing moisture buildup and maintaining a dry environment. Inadequate ventilation can promote corrosion, rust, and other damage to metal parts of the boat. Additionally, the continuous presence of pooled water on the boat cover can accelerate wear and tear. The water, combined with dust and debris, creates an abrasive environment that can degrade the cover's fabric, leading to premature deterioration.

One way to mitigate these problems entails using a boat cover suspension system. A boat cover suspension system includes a lashing or lifting point attached to a portion of a boat cover that may otherwise sag. A support structure in the form of a tower or pillar extends upwardly from the deck or gunwales of the boat. A tether, such as a strap or cable, connects the lashing point to the tower. The tether maintains a peak in the cover that facilitates runoff, rather than pooling.

An example of such a suspension system is provided in U.S. Pat. No. 7,987,807, which discloses a pair of concave disc clamping members secured together with screws, with a portion of a cover disposed therebetween. A ring is attached to an exterior side clamping member. A functionally similar suspension system is illustrated in US Design U.S. Pat. No. 932,416. Such prior art clamping members are difficult to attach. Small screws or nuts and bolts, which are easy to lose, are required to attach the mechanism to a cover. The attachment hardware is metal (e.g., steel or aluminum), which corrodes over time and discolors the cover. The ring moves relative to the clamping member. The ring movement produces noise when the cover flutters in wind. The movement also weakens the ring over time, which can lead to premature failure. Additionally, these devices do not facilitate ventilation. Inevitably, some water gets past the cover. The cover traps water and moisture, leading to mold and mildew.

Additionally, the suspension devices of U.S. Pat. No. 7,987,807 and US Design U.S. Pat. No. 932,416 do not support areas of a cover away from the suspension point.

Several of the devices must be applied to a cover to prevent sagging and pooling at certain areas, particularly near the transom.

What is needed is a lashing device attached to a boat cover without additional hardware and without a movable ring. The device should facilitate supporting a substantial portion of the cover. Support should be provided along a distance extending away from the lashing point. The lashing point should facilitate ventilation to mitigate mold and mildew. The lashing point should also provide pressure relief. The invention is directed to overcoming one or more of the problems and solving one or more of the needs as set forth above.

SUMMARY OF THE INVENTION

To solve one or more of the problems set forth above, in an exemplary implementation of the invention, an exemplary lashing assembly (i.e., boat cover suspension device) includes an outer cap and an inner cap. The outer cap includes an annular flange, a tubular fitting defining an aperture, and a strap attachment bar or wall—(i.e., divider) spanning the aperture at one end of the aperture. The inner cap includes a body, rim and bushing. The outer and inner caps are each integrally formed, molded or cast structures. When assembled, the tubular fitting of the outer cap is received in the bushing of the inner cap, and held in place by friction, glue, threads or mechanical connections such as snap fit couplings. A portion of a cover is disposed between the annular flange of the outer cap and the body of the inner cap. A tether attaches the lashing assembly to a support structure above a boat deck. The support structure may be a tow tower. The tethered lashing assembly maintains the retained portion of the cover in an elevated position, forming a peak in the cover, which causes water to runoff. One or more additional tethers or tether segments extend in diverging directions from the fitting, beneath a cover, to anchor points, thereby supporting portions of the cover from the lashing assembly to the anchor points. The anchor points may be portions of the cover, or structures on the boat (e.g., D-rings at or near the transom of the boat).

The exemplary lashing assembly according to principles of the invention includes an outer cap and an inner cap. The outer cap includes an annular flange, a tubular fitting defining an aperture, and a strap attachment bar or wall (i.e., divider) spanning the aperture at one end of the aperture. The inner cap includes a body, rim and bushing. The outer and inner caps are each integrally formed, molded or cast structures. When assembled, the tubular fitting of the outer cap is received in the bushing of the inner cap, and held in place by friction, glue, threads or mechanical connections such as snap fit couplings. A portion of a cover is disposed between the annular flange of the outer cap and the body of the inner cap. One end of a tether attaches to the strap attachment bar. The other end of the tether attaches to a support structure above a boat deck. The support structure may be a tow tower. The tethered lashing assembly maintains the retained portion of the cover in an elevated position, forming a peak in the cover, which causes water to runoff.

In a particular embodiment, the first cap has a tubular fitting, an annular flange at a first end of the tubular fitting, and a divider bisecting the tubular fitting at the first end. The divider divides the interior space of the tubular fitting into two compartments or sections, which may or may not be equal in shape and volume. A second cap includes a bushing and an annular body at a second end of the bushing. The bushing is configured to securely receive at least a portion of the tubular fitting. The annular flange and annular body are approximately the same sizes (e.g., have approximately the same outer diameters). The divider is a bar or wall extending from a first side of the tubular fitting to an opposite second side of the tubular fitting. The bar including filleted (rounded) edges, not sharp corners. The tubular fitting defines a ventilation port. The tubular fitting has an annulus cross section shape. The bushing has a second length. The first length of the tubular fitting is at least equal to the second length. The divider has a height that is about equal to the first length. Thus, the divider is approximately coextensive with the tubular fitting. The annular body also includes a peripheral rim that extends towards the first cap. A plurality of evenly spaced apart reinforcing ribs extend from the bushing to the rim. The first cap and second cap are each integrally formed, such as from injection molded plastic.

The divider may be a bar or wall that extends from a first side of the tubular fitting to an opposite second side of the tubular fitting. The divider may be coextensive with (i.e., equal in length with) the tubular fitting or shorter than the tubular fitting.

A first tether portion extends upwardly from and exerts an upward force on the device, i.e., on at least one of the first cap and the second cap. The first tether portion may be coupled to a tow tower or a similar support structure.

A second tether portion and a third tether portion extend toward the bow or the stern. The second tether portion diverges from the third tether portion. In one implementation, the second tether portion and the third tether portion extend toward a transom. The second tether portion includes a second free end and the third tether portion including a third free end. The second free end is coupled to a second free end anchor point. The third free end is coupled to a third free end anchor point. The second free end anchor point may be a first fixture (e.g., a D-ring, cleat, handle or rail) adjacent to (i.e., at or near) a transom. Likewise, the third free end anchor point may be a second fixture (e.g., a D-ring, cleat, handle or rail) adjacent to (i.e., at or near) the transom.

In another implementation, the second free end anchor point is a second free end attachment point on the boat cover. Likewise, the third free end anchor point is a third free end attachment point on the boat cover.

In another embodiment, at least one of the second tether portion and the third tether portion includes a length adjustment mechanism. The length adjustment mechanism may be a ratchet winch or a cam buckle.

The first and second caps may each be integrally formed. The first and second caps may each be formed from injection molded plastic.

In one embodiment, the tubular fitting is externally threaded and the bushing is internally threaded and configured to threadedly mate with the tubular fitting. In another embodiment, the tubular fitting includes a snap-fit coupling. The snap fit coupling releasably engages the bushing. A-nonlimiting example of a snap fit coupling is a cantilever hook formed in the tubular fitting. The bushing may include a slot configured to be releasably engaged by the cantilever hook.

A boat cover suspension system according to principles of the invention includes a lashing assembly attached to a boat cover. The boat cover has an upper side and a lower side. The lower side is opposite the upper side. A first tether portion is coupled to the lashing assembly and extends (e.g., upwardly) from the upper side of the boat cover. A second tether portion is coupled to the lashing assembly and extends beneath the lower side of the boat cover. Similarly, a third tether portion is coupled to the lashing assembly and extends beneath the lower side of the cover. The third tether portion diverges from the second tether portion, meaning the ends opposite the lashing assembly are further apart. The first tether portion supports the lashing assembly at a determined height. The second tether portion and third tether portion support portions of the boat cover beneath which the second tether portion and the third tether portion extend.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exemplary lashing assembly according to principles of the invention includes an outer cap and an inner cap. The outer cap includes an annular flange, a tubular fitting defining an aperture, and a strap attachment bar or wall (i.e., divider) spanning the aperture at one end of the aperture. The inner cap includes a body, rim and bushing. The outer and inner caps are each integrally formed, molded or cast structures. When assembled, the tubular fitting of the outer cap is received in the bushing of the inner cap, and held in place by friction, glue, threads or mechanical connections such as snap fit couplings. A portion of a cover is disposed between the annular flange of the outer cap and the body of the inner cap. A tether attaches the lashing assembly to a support structure above a boat deck. The support structure may be a tow tower. The tethered lashing assembly maintains the retained portion of the cover in an elevated position, forming a peak in the cover, which causes water to runoff. One or more additional tethers or tether segments extend in divergent directions from the fitting, beneath a cover, to anchor points, thereby supporting portions of the cover from the lashing assembly to the anchor points. The anchor points may be portions of the cover, or structures on the boat (e.g., D-rings at or near the transom of the boat).

Figure 1:
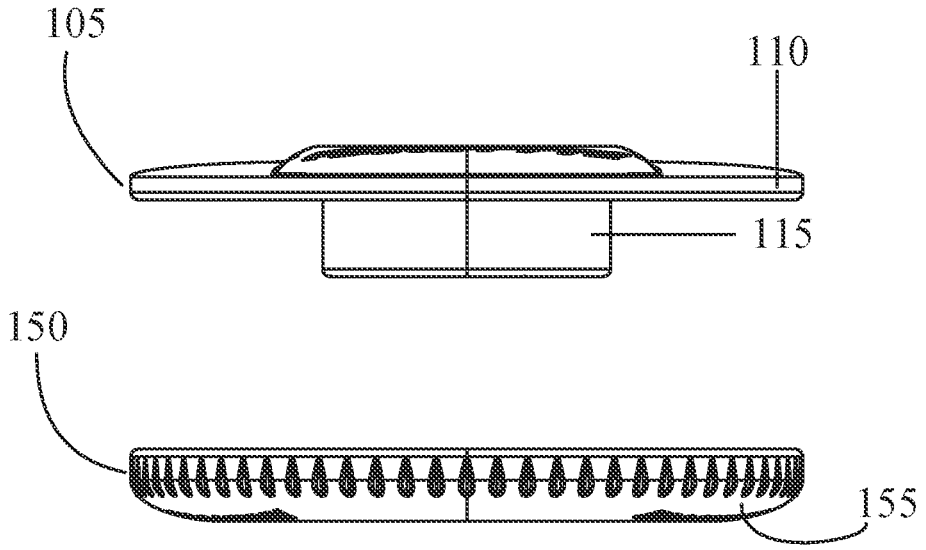
FIG. 1 is a side disassembled view of an exemplary lashing assembly for a boat cover suspension system according to principles of the invention.
Figure 2:
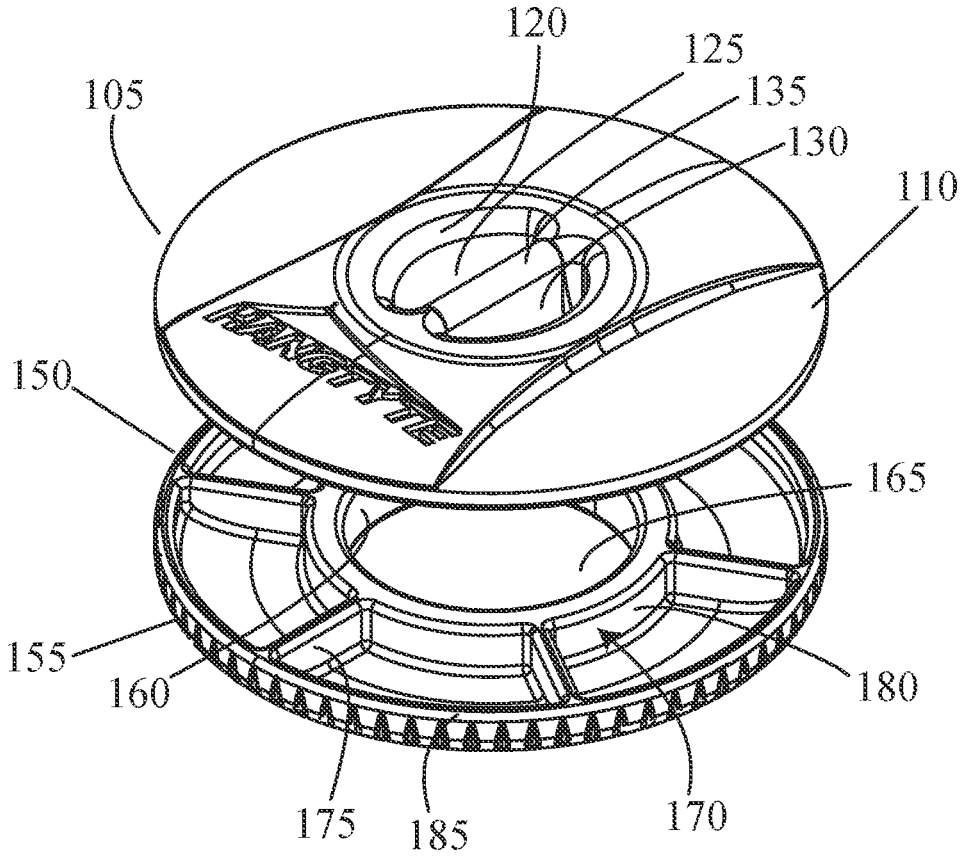
FIG. 2 is a perspective disassembled view of an exemplary lashing assembly for a boat cover suspension system according to principles of the invention.
Figure 3:
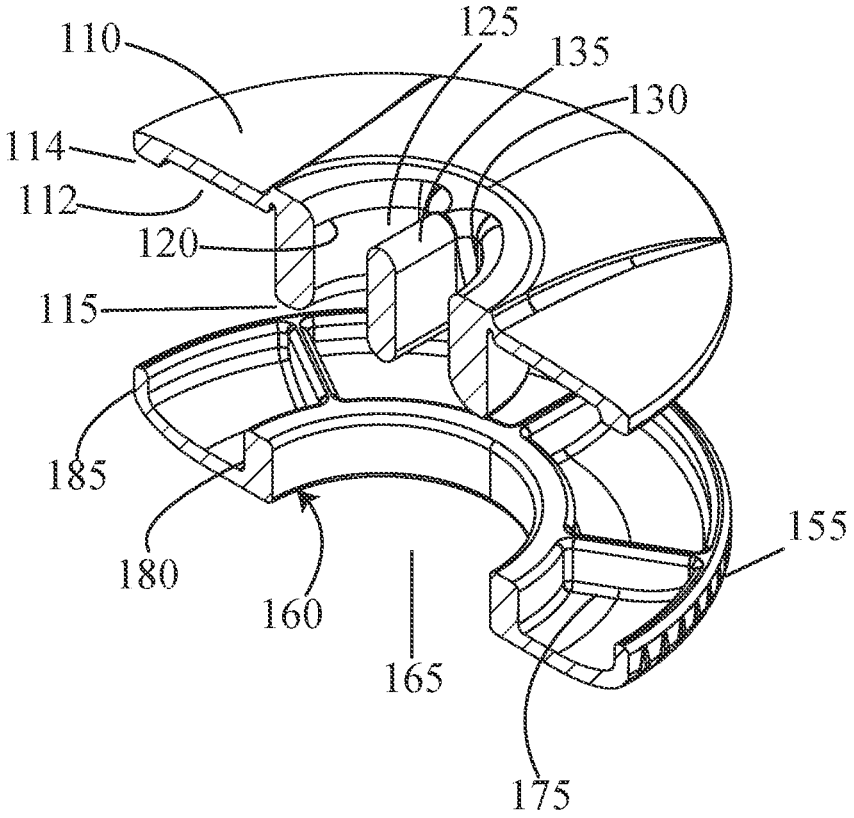
FIG. 3 is a perspective section view of an exemplary lashing assembly for a boat cover suspension system according to principles of the invention.

FIGS. 1-3 conceptually illustrate parts of an exemplary lashing assembly, in a disassembled arrangement, for a boat cover suspension system according to principles of the invention. The terms outer and inner are used for convenience of reference and not to limit the invention to a particular arrangement of components. An outer cap 105 may be located on either side of a boat cover. Likewise, an inner cap 150 may be located on either side of a boat cover. The outer cap 105 and inner cap 150 are located on opposite sides of a boat cover.

The outer cap 105 includes an annular flange 110, a tubular fitting 115 defining an aperture 120, and a divider 135 spanning the aperture 120 at one end of the aperture 120. The divider 135 divides the aperture 120 into two sections 125, 130. As illustrated, the flange 110 is disc-shaped with a slight concavity. The flange 110 includes a flange body 112 extending to an outer rim 114. The outer rim 114 is thicker than the body 112 to provide rigidity and an engagement point for an engaged cover. The exemplary tubular fitting 115 has an annulus cross section. However, the invention is not limited to a tubular fitting with an annular cross-section. A tubular fitting having another shape may be used without departing from the scope of the invention.

The inner cap 150 includes a body 155, a peripheral rim 185 and a bushing 170. The bushing 170 defines a port 165 in which the fitting 115 may be received. The fitting 115 fits snugly within the port 165. The diameter of the port 165 at the inner wall 160 of the bushing 170 is about equal (slightly larger) than the outer diameter of the fitting 115. In the case of a fitting with a non-circular cross section shape, the size and shape of the port are about the same as those of the fitting, with the dimensions being equal or slightly larger.

The outer diameters of the outer cap 105 and the inner cap 150 are about equal. The outer rim 114 of the flange 110 of the outer cap 105 and the rim 185 of the inner cap 150 align when the lashing assembly 100 is assembled.

Reinforcing ribs 175 extend between the outer wall 180 of the bushing 170 to the rim 185, similar to spokes of a wagon wheel extending from the hub of the wheel. The ribs 175 enhance strength at minimal weight. The structural enhancement reduces the volume of plastic required to produce a strong product.

The aperture 120 of the outer cap 105 defines a passageway for segments of tethers. One or more segments may be used to support the lashing assembly 100 and engaged portions of a boat cover in a raised position. Other segments may be used to support areas of the boat cover between the lashing assembly 100 and anchor points in a raised position. The anchor points may comprise structures such as D-rings, cleats, rails or structure to which a tether may be securely attached. Alternatively, anchor points may constitute portions of the cover. These other segments may extend divergently from the lashing assembly 100 to the anchor points. In a particular implementation, the anchor points are at or near the transom of a boat.

The aperture 120 of the outer cap 105 also defines a vent when the fitting 115 is received in the bushing 170. The vent defined by the aperture 120 allows air and vapors to flow between the volume covered by a boat cover and the exterior. The vent does not admit appreciable water into the volume below the cover. The divider 135 and a tether that extends through the aperture 120 and bends around the divider 135 occupy an appreciable portion of the aperture 120. This configuration prevents substantial water from entering through the aperture 120 while providing ample unoccupied space for ventilation.

Figure 4:
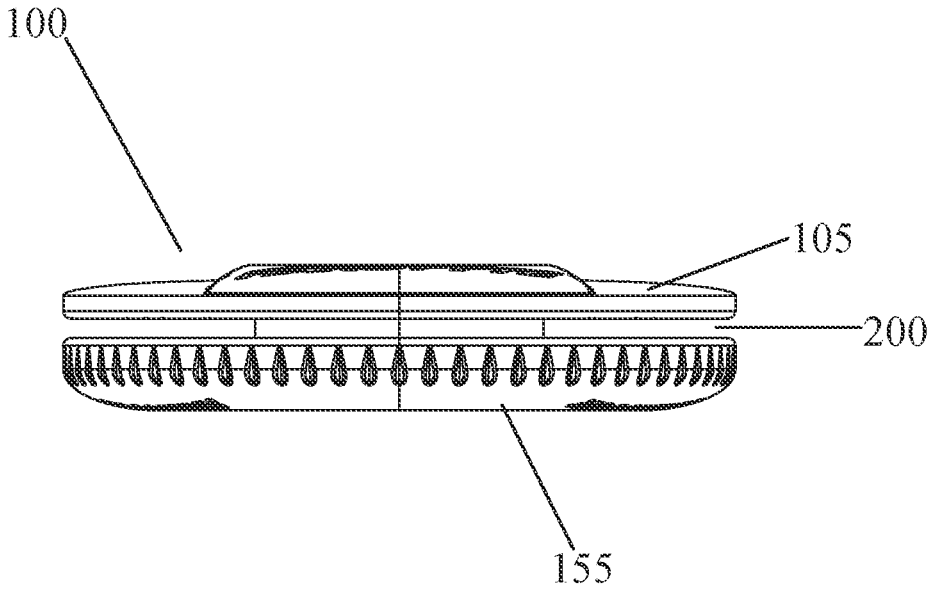
FIG. 4 is a side assembled view of an exemplary lashing assembly for a boat cover suspension system according to principles of the invention.
Figure 5:
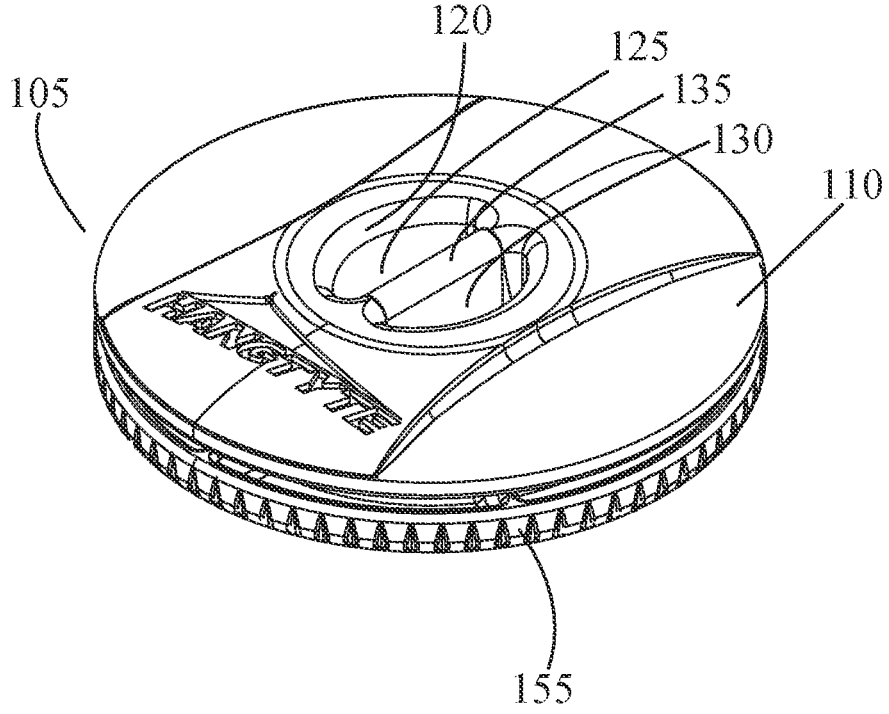
FIG. 5 is a perspective assembled view of an exemplary lashing assembly for a boat cover suspension system according to principles of the invention.

FIGS. 4 and 5 conceptually illustrate an exemplary lashing assembly 100 for a boat cover suspension system according to principles of the invention. A space 200 between the outer 105 and inner caps is occupied by a portion of a boat cover, when the lashing assembly is installed on a boat cover. The space 200 may be sized to accommodate a wide range of thicknesses of boat covers. The space 200 may be increased by moving the outer cap 105 away from the inner cap 155. The space 200 may be decreased by moving the outer cap 105 towards the inner cap 155. The space 200 may be eliminated by pressing the outer rim 114 of the flange 110 of the outer cap 105 flush against the rim 185 of the inner cap 150.

The outer 105 and inner 150 caps are each integrally formed, molded or cast structures. When assembled, the tubular fitting 115 of the outer cap 105 is received in the bushing 170 of the inner cap 150, and held in place by friction, glue, threads or mechanical connections such as snap fit couplings. A portion of a cover is disposed in the space 200 between the annular flange of the outer cap and the body of the inner cap. A tether may be attached to the divider 135. The tether may also be attached to a support structure above a boat deck. The support structure may be a tow tower. The tethered lashing assembly 100 maintains the retained portion 205 of the cover 200 in an elevated position, forming a peak in the cover, which causes water to runoff. Concomitantly, another tether or additional portions of the tether may extend from the fitting 115 below a cover to anchor points. These portions may be drawn taught (in tension), thus supporting the cover from the lashing assembly 100 to the anchor points.

Figure 6:
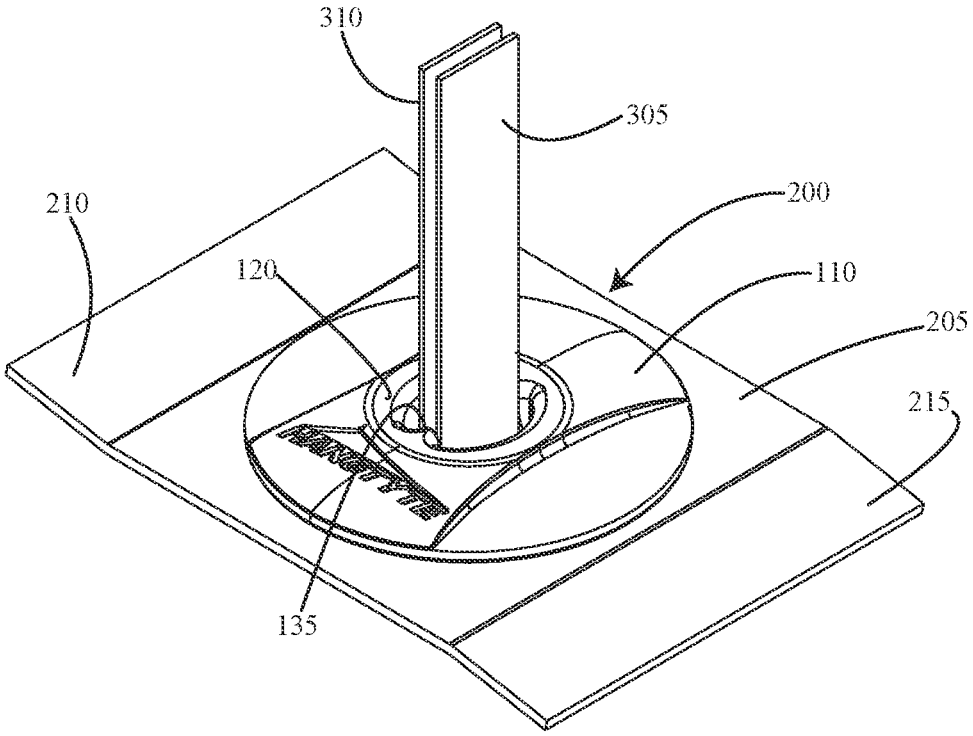
FIG. 6 is a perspective assembled view of an exemplary lashing assembly installed on a portion of a boat cover for a suspension system according to principles of the invention.
Figure 7:
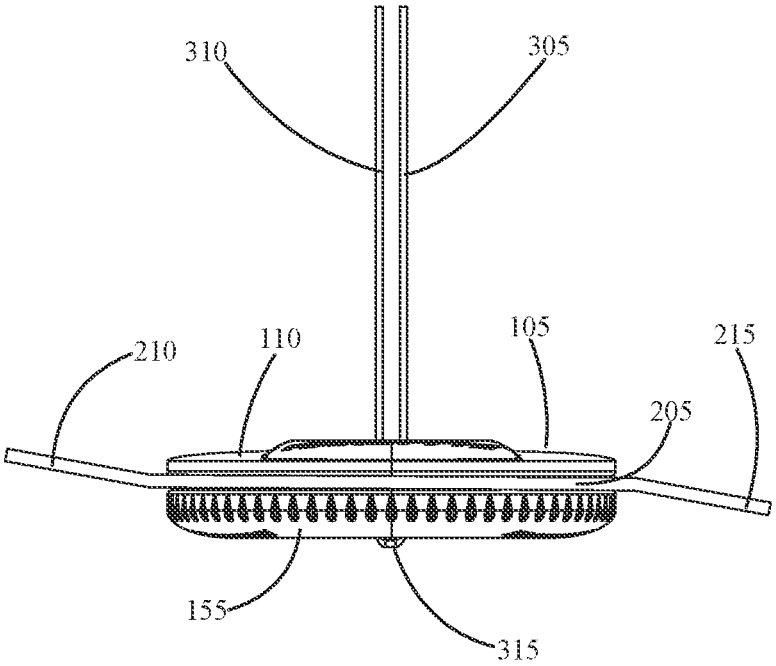
FIG. 7 is a side assembled view of an exemplary lashing assembly installed on a portion of a boat cover for a suspension system according to principles of the invention.
Figure 8:
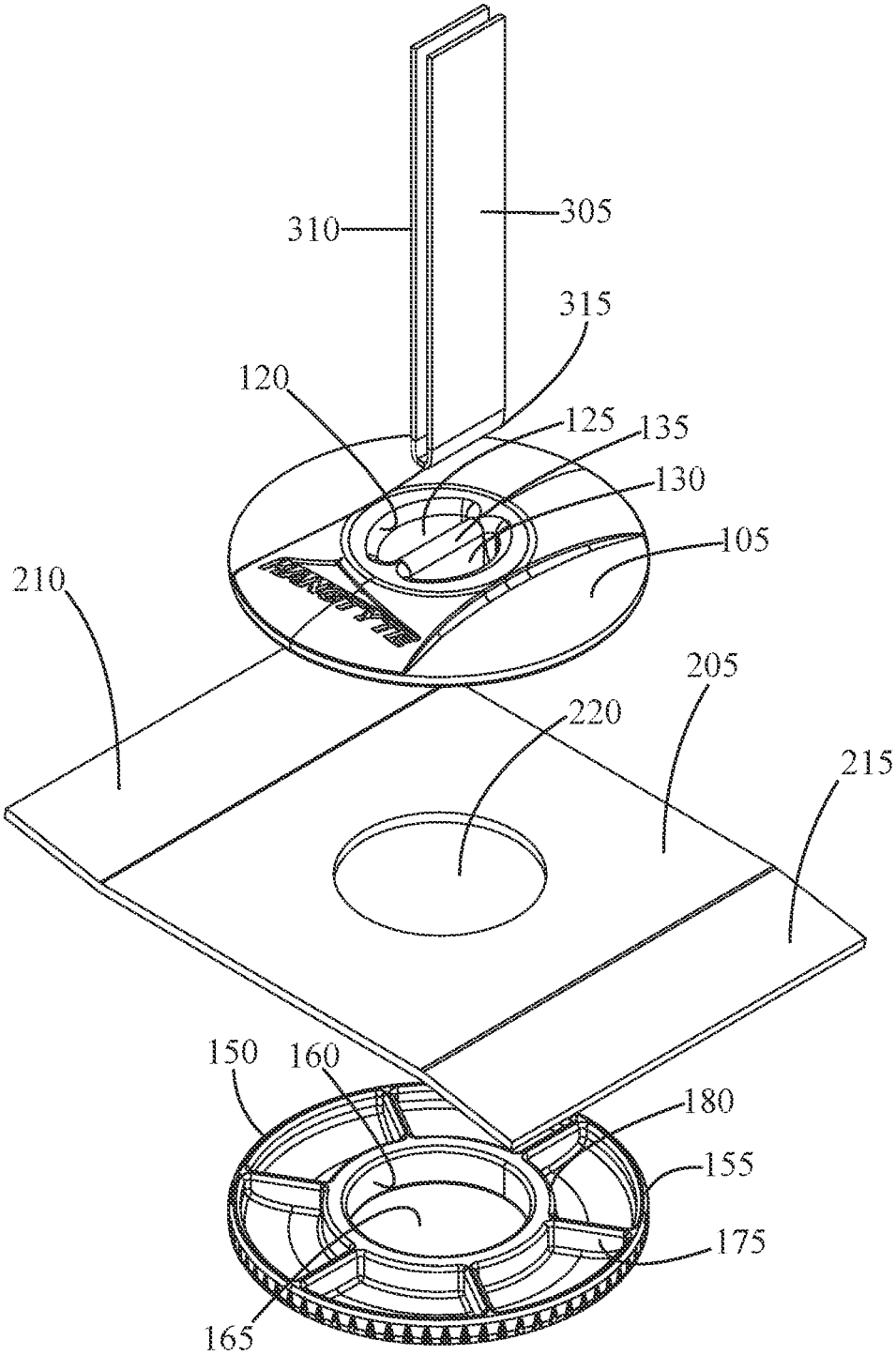
FIG. 8 is a perspective exploded view of an exemplary lashing assembly with a portion of a boat cover for a suspension system according to principles of the invention.

FIGS. 6 and 7 conceptually illustrate an exemplary lashing assembly 100 installed on a portion of a boat cover 200 for a suspension system according to principles of the invention. A tether 300 attaches to a support structure and the divider 135. In the exemplary embodiment, the tether 300 is threaded through the aperture 120, around the divider 135, with one section 305 of the tether 300 extending through one portion 130 of the aperture 120 and the other section 310 extending through the other portion 125 of the aperture. FIG. 8 shows the bend 315 of the tether 300, which is the portion of the tether 300 that wraps around the divider 135.

In the exemplary embodiment, the tether 300 is comprised of nylon, polyester or polypropylene webbing strap or rope. Wire rope may be used. Braided rope and paracord comprised of nylon or polyester may also be used. Other materials and forms of tethers may be used without departing from the scope of the invention. The tether is sized to support the weight of the cover 200 when wet and counteract any tension from adjacent portions of the cover 200. In the exemplary embodiment, the strap is sized (e.g., has a width) to fit within the portions 125, 130 of the aperture 120. In another embodiment, the tether 300 may include a hook or loop that engages the divider 135. Tethers of various constructions, widths and thicknesses may be used. Each compartment 125, 130 of the aperture 120 is sized to allow passage of a received segment of a tether. In the case of straps, several strap segments may extend through each compartment 125, 130. If necessary, straps segments may be bunched up or overlapping to provide sufficient space.

Figure 16:
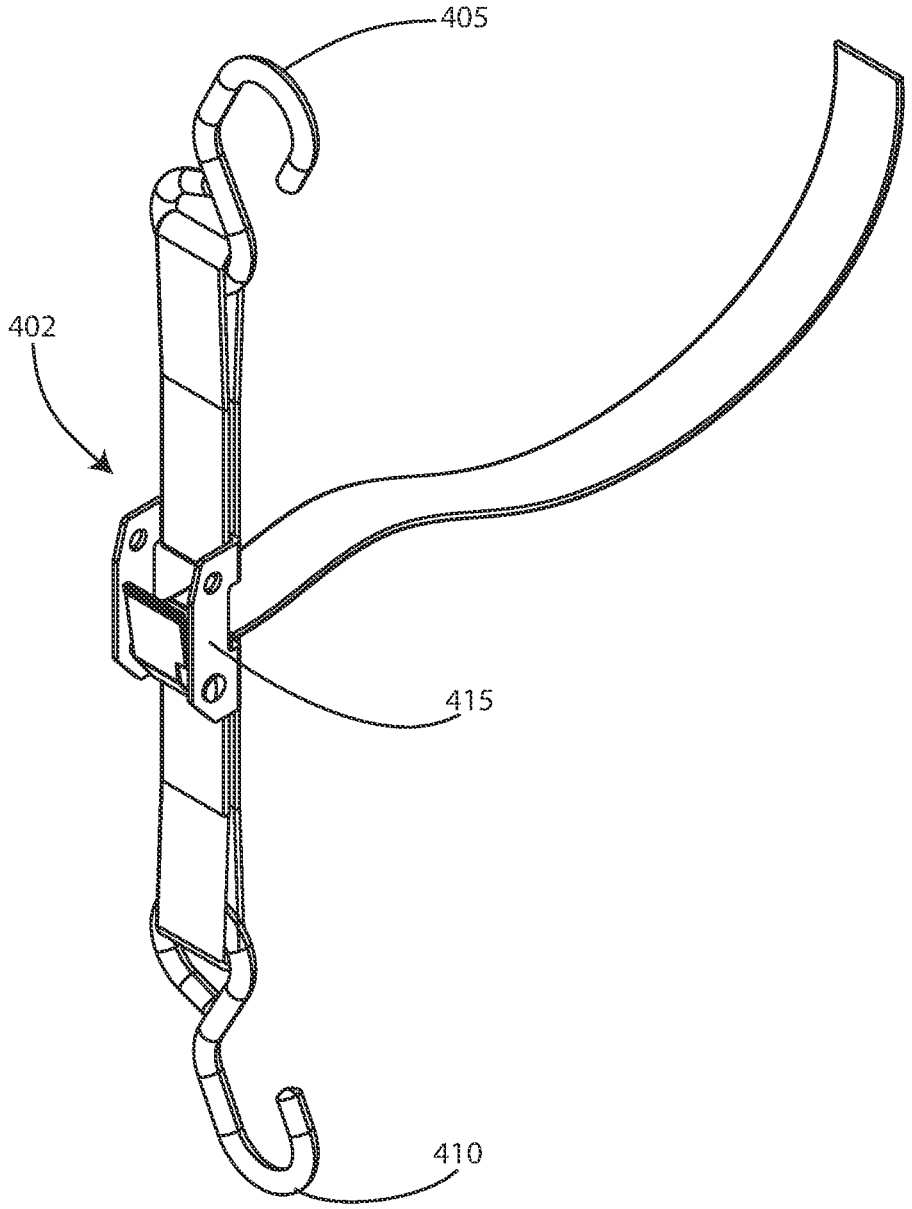
FIG. 16 is a perspective view of an exemplary cam buckle strap assembly for a lashing assembly according to principles of the invention.
Figure 17:
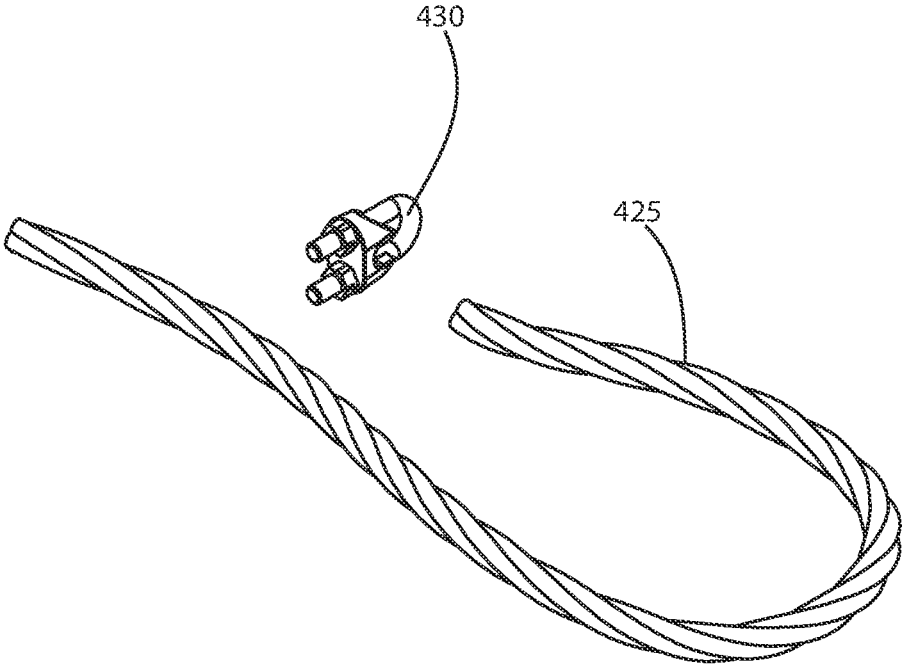
FIG. 17 is a perspective view of an exemplary rope and clamp for a lashing assembly according to principles of the invention.

Tethers may include hardware on ends, such as hooks 405, 410 (FIG. 16) on the ends of a strap assembly 402, with a cam buckle 415, i.e., a mechanism for adjusting length. As another example, a rope clamp 430 (FIG. 17) may be provided to secure ends of a rope 425 or wire rope in a loop.

Tension in the tether 300 maintains the cover 200 in an elevated position to facilitate runoff and prevent pooling of water. The tension is sufficient to support the weight of the supported portion of the cover 200 and counteract downward pulling by adjacent portions 210, 215 of the cover 200.

The lashing assembly 100 is not limited to any particular location or orientation. The location and orientation shown in the Figures is provided as a nonlimiting example. Other locations and orientations may be used, within the scope of the invention. By way of example, and not limitation, the lashing assembly 100 may be rotated 90 degrees (or more or less) relative to the orientation shown in FIGS. 6-7. The location may be different from the location shown in FIG. 10. More than one lashing assembly 100 may be used. All such variations come within the scope of the invention.

FIG. 8 provides an exploded view of the exemplary lashing assembly 100 and the portion of the boat cover 200 for a suspension system according to principles of the invention. A hole 220 is formed in the cover 200. The hole 220 is sized and shaped to receive the tubular fitting 115. The diameter of the hole 220 is at least as large, about equal to, slightly larger than the diameter of the tubular fitting 115, to allow the fitting 115 to extend through the hole 220 without tearing the cover 200.

Figure 9:
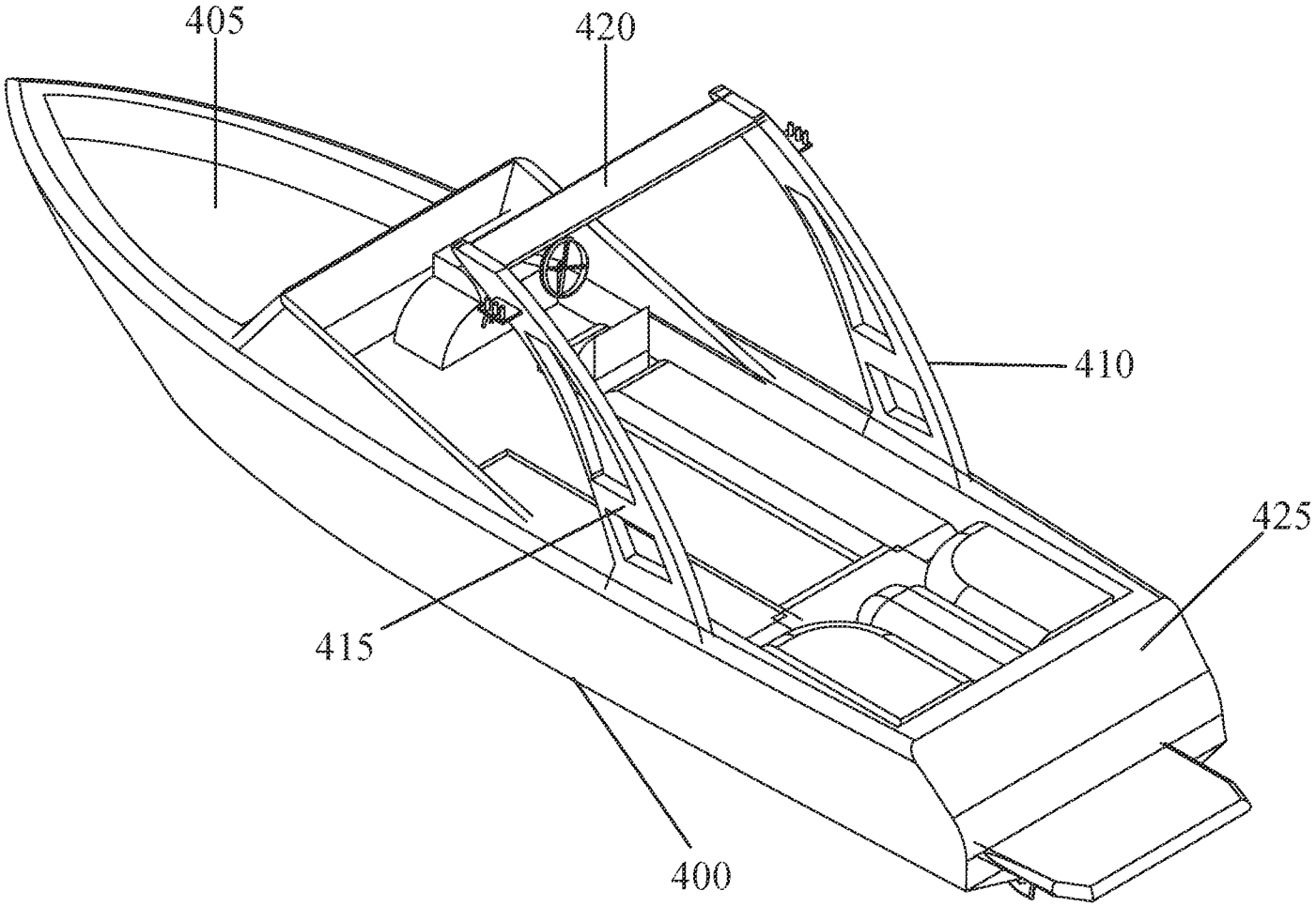
FIG. 9 is an exemplary boat on which a boat cover suspension system according to principles of the invention may be used.

FIG. 9 conceptually illustrates an exemplary boat 400 on which the invention may be used. The boat includes a deck 405 and cockpit 425. The boat 400 also includes a tower, comprising a pair of struts 410, 415 extending upwardly from the gunwales to a cross bar 420. Such a tower is used to tow water skiers, wakeboarders and other recreational and sporting equipment. While many boats do not include a tower, such boats may be equipped with a permanent or temporary removable tower-like support structure that includes a pair of upright supports extending from the deck or gunwales, and a crossbar extending between the upright supports.

Figure 10:
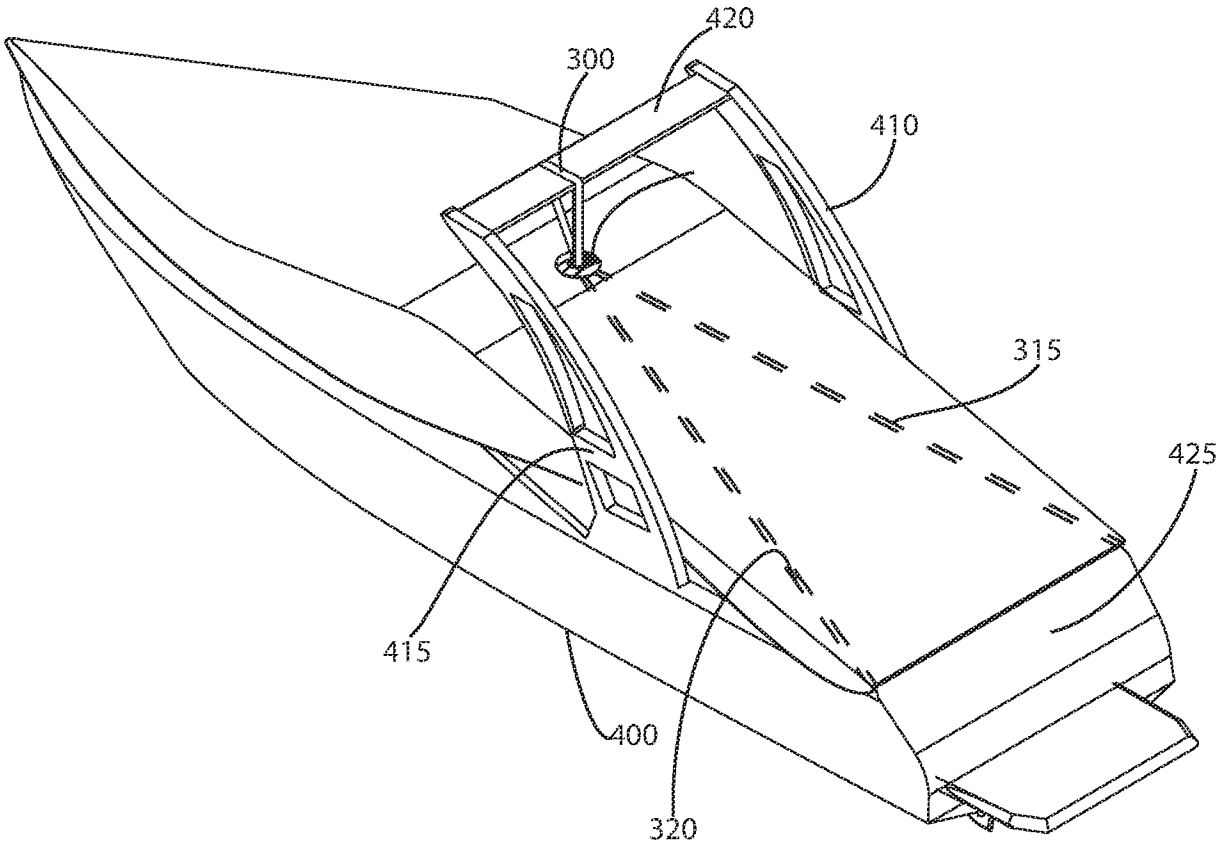
FIG. 10 is the exemplary boat on which a boat cover suspension system according to principles of the invention is used.

In FIG. 10 a boat cover suspension system according to principles of the invention is shown on the boat 400 of FIG. 9. One lashing assembly 100 is shown. However, the invention is not limited to one lashing assembly 100. More than one lashing assembly may be used with a cover 200. A plurality of lashing assemblies may be attached at areas of the boat cover that are conducive to sagging. A strap 300 couples the lashing assembly 100 to the tower crossbar 420. The strap 300 is configured to support the portion 205 of cover 200 to which the lashing assembly is attached 100. The support resists sagging that would otherwise cause pooling of water. The lashing assembly 100 provides ventilation, allowing airflow through the lashing assembly between the ambient environment and the space beneath the cover 200.

Figure 14:
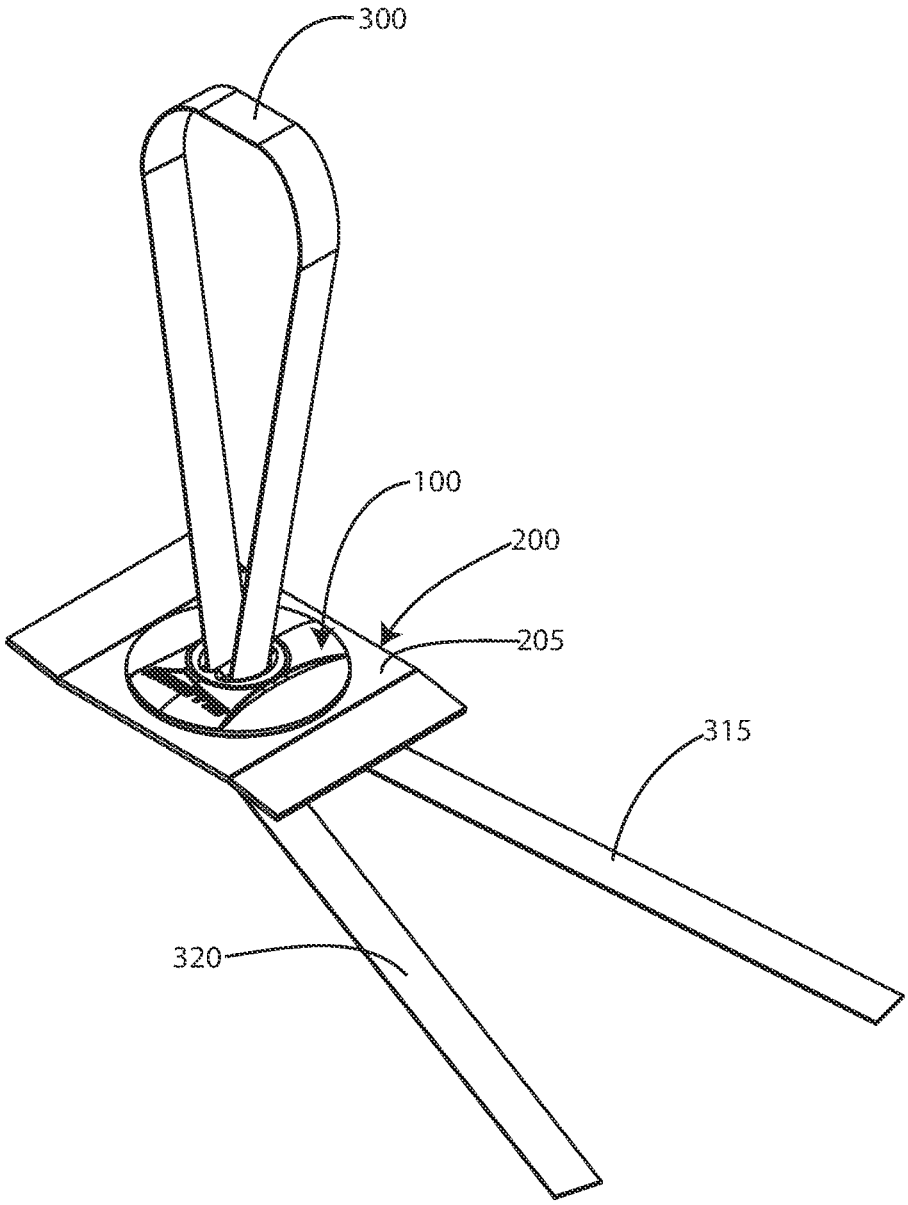
FIG. 14 is a perspective view of an exemplary lashing assembly with diverging strap segments extending therefrom for supporting a cover thereon according to principles of the invention.

As shown in FIG. 14, an additional tether or additional portions of 315, 320 of the tether 300, extend from the lashing assembly 100, beneath the cover 200, to anchor points. The anchor points may be D-rings, cleats, rails or other similar fixtures at or near the transom 425 of the boat 400. The additional tether or additional portions of 315, 320 of the tether 300, may diverge from the lashing assembly 100 to the respective anchor points. The additional tether or additional portions of 315, 320 of the tether 300 are drawn taught, exerting a tensile force between the anchor points and the lashing assembly 100.

Figure 15:
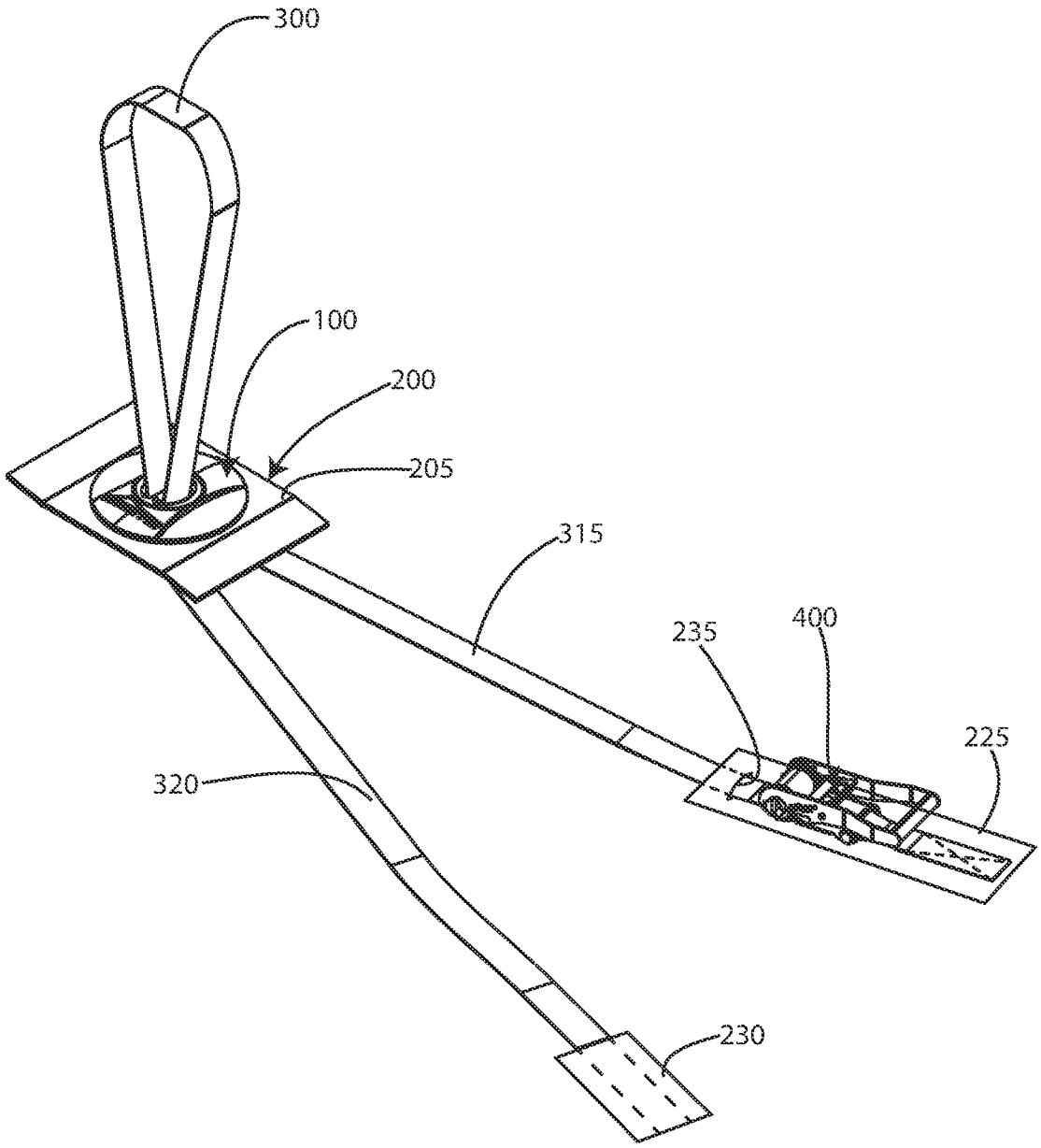
FIG. 15 is a perspective view of an exemplary lashing assembly with diverging strap segments extending therefrom, one of which is coupled to a ratchet winch, for supporting a cover thereon according to principles of the invention.

FIG. 15 provides perspective view of an exemplary lashing assembly 100 with diverging strap segments 315, 320 extending therefrom. Segment 320 extends beneath the cover 200 to a remote portion 230 of the cover 200. Segment 315 extends beneath the cover 200 to a slit 235 adjacent to another remote portion 225. One of the divergent strap segments 315 is coupled to a ratchet winch 400. The ratchet winch 400 is a device for adjusting the length of the strap segment 315 by winding up an unused portion on a spool of the ratchet winch. Adjusting the length adjusts the tension in the segment 315. If segment 320 is connected to segment 315, then adjusting the length and tension of 315 also adjusts the length and tension of segment 320. The ends of the segments 315, 320 may be anchored to a fixed structure (fixture) on the boat, such as a D-ring, handle, cleat or rail, or may be anchored (e.g., stitched and/or bonded) to portions 225, 230 of the cover 200. The segments 315, 320 are in tension, thus providing a support structure for the portions of the cover from the lashing assembly 100 to the anchors 225, 230. While only portions 205, 225 and 230 of the boat cover 200 are shown in FIG. 15, those skilled in the art will appreciate that the portions 205, 225 and 230 are not separate independent structures, but rather are integral parts of the cover 200.

The ratchet winch 400 may be located on the outer (top) side of the cover to facilitate access to and use thereof. Thus, for example, a small slit 235 may be provided in the cover 200 adjacent to the ratchet winch 400 for the strap segment 315 to extend through the cover 200 from the underside to the outer side. In this manner, the strap segment 315 supports the cover 200 while the length adjustment mechanism 400 remains accessible. Optionally, a cover, e.g., a zippered cover or pocket, may be provided to protect the mechanism 400 from the elements when not in use for length adjustment.

The lashing assembly 100 illustrated in FIGS. 1-8 includes a tubular fitting 115 that is received in the bushing 170. The fitting 115 may be retained in the bushing 170 via friction. Alternatively, the fitting 115 may be permanently secured in the bushing 170 with glue or solvent cement. As another alternative, a set screw may extend through a sidewall of the bushing 170 to the fitting 115 received therein. Tightening the set screw exerts a retaining force against the fitting 115, to resist its removal from the bushing 170.

Figure 11:
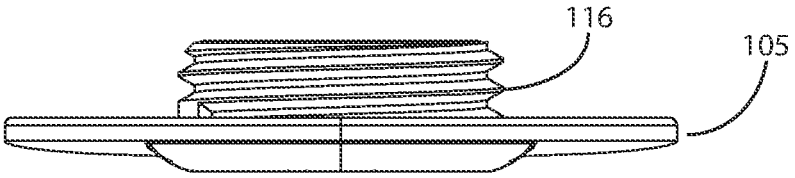
FIG. 11 is a portion of a lashing assembly with a threaded annular flange to facilitate attachment for a suspension system according to principles of the invention.

In another embodiment, as shown in FIG. 11, at least a portion of the fitting 115 may be threaded 116 with external threads. The bushing 170 may be have internal threads configured to mate with the external threads 116 of the fitting. In this embodiment, the outer cap 105 is threaded to the inner cap 150.

O-rings or washers (e.g., plastic washers) may be located on (i.e., surrounding) the fitting. The retained portion 205 of the cover 200 may be disposed between the washers. The washers may protect the retained portion 205 of the cover 200 from abrasion and torsion due to twisting of the outer cap 105 relative to the inner cap 150, such as during installation.

Figure 12:
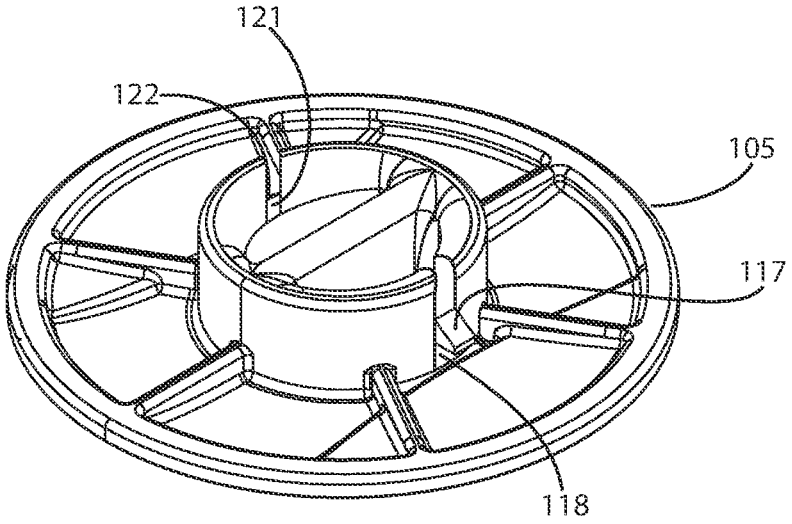
FIG. 12 is a portion of a lashing assembly with cantilever hooks to facilitate attachment for a suspension system according to principles of the invention.
Figure 13:
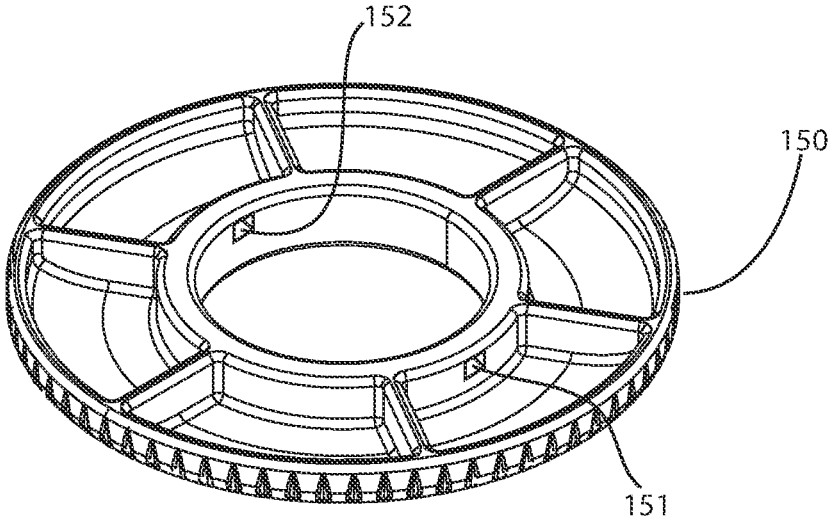
FIG. 13 is a portion of a lashing assembly with slots to engage cantilever hooks for a suspension system according to principles of the invention.

In yet another embodiment, snap fit connections may releasably secure the outer cap 105 to the inner cap 150. By way of example, as conceptually illustrated in FIGS. 12 and 13, the fitting 115 may include one or more flexible cantilever hooks 117, 122, each include a flexible cantilever beam 118, 121. The bushing 170 is equipped with slots 151, 152 that are sized and positioned to receive the wedge-shaped heads of the cantilever hooks 117, 122 when the outer cap 105 is aligned with and pushed into mating position with the inner cap 150. The wedge shape allows the cantilever hooks 117, 122 to deflect inwardly as the fitting 115 is urged towards the bushing 170. When the wedge-shaped heads of the cantilever hooks 117, 122 align with the slots 151, 152, the heads spring into the slots 151, 152, locking the assembly. To unlock the assembly and allow separation of the outer cap 105 from the inner cap 150, the heads may be pressed inwardly using a nail, screwdriver or the like.

Outer and inner 105, 150 caps according to principles of the invention may be comprised of metals, alloys, composites and/or any of various plastics. While many other materials may be used alone or in combination with the aforementioned materials and/or other materials, without departing from the scope of the present invention, preferably the material is relatively inexpensive, easy to use in manufacturing operations and results in an aesthetically acceptable, durable, high compression and tensile strength product. By way of example, inner and outer caps according to principles of the invention may be produced using any suitable plastic manufacturing techniques known in the art for the chosen material, such as (for example) injection, compression, structural foam, blow, or transfer molding; polyurethane foam processing techniques; vacuum forming; rapid 3D printing, and casting. The material may further include additives to provide desired properties such as structurally reinforcing additives (e.g., glass or carbon fibers), desired colors, structural characteristics, glow-in-the dark properties and thermal reactivity (e.g., color changes according to heat). In a preferred embodiment, the outer cap 105 and inner cap 150 is each integrally formed using injection molded plastic.

Any dimensions, amounts or concentrations are provided as approximations for a particular embodiment, unless expressly stated otherwise. Dimensions, amounts or concentrations may be varied without departing from the scope of the invention. Varied dimensions, amounts or concentrations that do not substantially impair utility of the invention come within the spirit and scope of the invention. Subject to the foregoing, unless otherwise specified herein, dimensions may be varied by ±5% without departing from the scope of the invention. About equal to means equal to or within ±5% of being equal. At least about means as great as or within ±5% of being as great as.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A boat cover suspension device comprising
   - a first cap comprising a tubular fitting, an annular flange at a first end of the tubular fitting, a divider bisecting the tubular fitting;
   - a second cap comprising a bushing, an annular body at a second end of the bushing, the bushing being configured to securely receive at least a portion of the tubular fitting; and
   - a first portion of a boat cover disposed between the annular flange and the annular body.

2. The boat cover suspension device of claim 1, the divider comprising a bar extending from a first side of the tubular fitting to an opposite second side of the tubular fitting.

3. The boat cover suspension device of claim 1, further comprising a first tether portion extending upwardly from and exerting an upward force on at least one of the first cap and the second cap, and a second tether portion and a third tether portion extending toward one of a bow and a stern of a boat, with the second tether portion diverging from the third tether portion.

4. The boat cover suspension device of claim 3, the second tether portion and the third tether portion extending toward a transom of the boat.

5. The boat cover suspension device of claim 3, the second tether portion including a second free end and the third tether portion including a third free end, and the second free end being coupled to a second free end anchor point, and the third free end being coupled to a third free end anchor point, the second tether portion and the third tether portion each extending beneath a lower side of the boat cover.

6. The boat cover suspension device of claim 5, the second free end anchor point comprising a first fixture adjacent to a transom of the boat, and the third free end anchor point comprising a second fixture adjacent to a transom of the boat, and the second tether portion and the third tether portion each being in tension.

7. The boat cover suspension device of claim 5, the second free end anchor point comprising a second free end attachment point on the boat cover, and the third free end anchor point comprising a third free end attachment point on the boat cover, the second tether portion and the third tether portion each extending beneath the lower side of the boat cover.

8. The boat cover suspension device of claim 1, the first tether portion being coupled to a tow tower.

9. The boat cover suspension device of claim 3, at least one of the second tether portion and the third tether portion including a length adjustment mechanism, the second tether portion and the third tether portion each extending beneath the lower side of the boat cover.

10. The boat cover suspension device of claim 9, the length adjustment mechanism comprising one of a ratchet winch and a cam buckle.

11. The boat cover suspension device of claim 1, the annular body further comprising a peripheral rim, the peripheral rim extending towards the first cap.

12. The boat cover suspension device of claim 8, further comprising a plurality of evenly spaced apart reinforcing ribs extending from the bushing to the rim.

13. The boat cover suspension device of claim 1, the first cap being integrally formed and the second cap being integrally formed.

14. The boat cover suspension device of claim 13, the first cap comprising injection molded plastic and the second cap comprising injection molded plastic.

15. The boat cover suspension device of claim 1, the tubular fitting being externally threaded and the bushing being internally threaded and configured to threadedly mate with the tubular fitting.

16. The boat cover suspension device of claim 1, the tubular fitting including a snap-fit coupling, the snap fit coupling releasably engaging the bushing.

17. The boat cover suspension device of claim 13, the snap fit coupling comprising a cantilever hook formed in the tubular fitting, and the bushing including a slot configured to be releasably engaged by the cantilever hook.

18. A boat cover suspension system comprising:

a lashing assembly attached to a boat cover, the lashing assembly including a first cap and a second cap secured to the first cap, the boat cover having an upper side and a lower side, the lower side being opposite the upper side, an engaged portion of the boat cover being disposed between the first cap and the second cap;

a first tether portion coupled to the lashing assembly and extending from the upper side of the boat cover to a support structure disposed above the boat cover;

a second tether portion coupled to the lashing assembly and extending beneath the lower side of the boat cover to a second tether anchor point;

wherein the first tether portion supports the lashing assembly at a determined height, and the second tether portion supports a portion of the boat cover beneath which the second tether portion extends, the second tether portion being distinct from and extending independently of the first tether portion.

19. The boat cover suspension system of claim 18, further comprising:

a third tether portion coupled to the lashing assembly and extending beneath the lower side of the boat cover, the third tether portion diverging from the second tether portion to a third tether anchor point;

wherein the third tether portion supports portions of the boat cover beneath which the second tether portion and the third tether portion extend, the second tether portion and the third tether portion together providing distributed support of the boat cover between the lashing assembly and the second and third tether anchor points.

20. A boat cover suspension system comprising:

a lashing assembly attached to a boat cover, the lashing assembly including a first cap and a second cap secured to the first cap, the first cap comprising a tubular fitting, an annular flange at a first end of the tubular fitting, and a divider bisecting the tubular fitting, the second cap comprising a bushing and an annular body at a second end of the bushing, the bushing being configured to securely receive at least a portion of the tubular fitting;

the boat cover having an upper side and a lower side opposite the upper side, an engaged portion of the boat cover being disposed between the annular flange and the annular body;

a first tether portion coupled to the lashing assembly and extending from the upper side of the boat cover to a support structure disposed above the boat cover;

a second tether portion coupled to the lashing assembly and extending beneath the lower side of the boat cover to a second tether anchor point;

a third tether portion coupled to the lashing assembly and extending beneath the lower side of the boat cover, the third tether portion diverging from the second tether portion to a third tether anchor point;

wherein the first tether portion supports the lashing assembly at a determined height, the second tether portion and the third tether portion each supporting portions of the boat cover beneath which they extend, the second tether portion and the third tether portion being distinct from and extending independently of the first tether portion.

* * * * *